United States Patent [19]

Reighard et al.

[11] Patent Number: 4,682,711

[45] Date of Patent: Jul. 28, 1987

[54] METHOD AND APPARATUS FOR SEALING WELDED SEAMS OF AUTOMOBILES

[75] Inventors: Alan B. Reighard, Hamburg, Mich.; Larry Soutar, Marietta, Ga.

[73] Assignee: Nordson Corporation, Amherst, Ohio

[21] Appl. No.: 720,695

[22] Filed: Apr. 8, 1985

[51] Int. Cl.[4] ..... B67D 5/00

[52] U.S. Cl. ..... 222/75; 222/135; 222/255; 222/265; 222/330; 239/332

[58] Field of Search ..... 222/135, 330, 255, 265, 222/71, 252, 372, 271, 75, 63, 318; 239/332, 526, 525, 124

[56] References Cited

U.S. PATENT DOCUMENTS

| | | | |
|---|---|---|---|
| 1,618,006 | 2/1927 | Hawxhurst . | |
| 2,266,354 | 12/1941 | Christenson et al. | 222/318 X |
| 2,804,993 | 9/1957 | Davis et al. | 222/75 |
| 3,000,053 | 9/1961 | Hart . | |
| 3,049,267 | 8/1962 | Edwards et al. | 222/255 X |
| 3,051,417 | 8/1962 | Frost et al. . | |
| 3,052,378 | 9/1962 | Wright et al. . | |
| 3,097,764 | 7/1963 | Loeser | 222/63 X |
| 3,383,044 | 5/1968 | Norstrud et al. | 239/310 X |
| 3,496,261 | 2/1970 | Parr . | |
| 3,556,346 | 1/1971 | Steiner | 222/63 |
| 3,580,509 | 5/1971 | Goss | 239/526 X |
| 3,692,214 | 9/1972 | Liedberg et al. . | |
| 3,720,373 | 3/1973 | Levey . | |
| 3,885,739 | 5/1975 | Tuttle | 239/124 |
| 3,964,645 | 6/1976 | Scholl | 222/330 X |
| 3,997,080 | 12/1976 | Langstroth . | |
| 4,009,974 | 3/1977 | Scholl . | |
| 4,165,818 | 8/1979 | Bernard . | |
| 4,227,069 | 10/1980 | Gardner et al. . | |
| 4,245,759 | 1/1981 | Baker et al. . | |
| 4,279,360 | 7/1981 | Hauser . | |
| 4,390,126 | 6/1983 | Buchholz et al. | 239/124 X |

*Primary Examiner*—Joseph J. Rolla
*Assistant Examiner*—Edward S. Ammeen
*Attorney, Agent, or Firm*—Wood, Herron & Evans

[57] ABSTRACT

A system for applying sealant material to the welded seams of an automobile body including a reciprocating piston pump for supplying the material under pressure from a reservoir to an overhead distribution manifold. From the manifold the material is supplied to a plurality of extrusion guns through drop lines, each of which includes a pressure regulator and volumetric metering gear pump for maintaining a constant flow rate to the guns irrespective of pressure changes which may occur in the distribution manifold.

8 Claims, 1 Drawing Figure

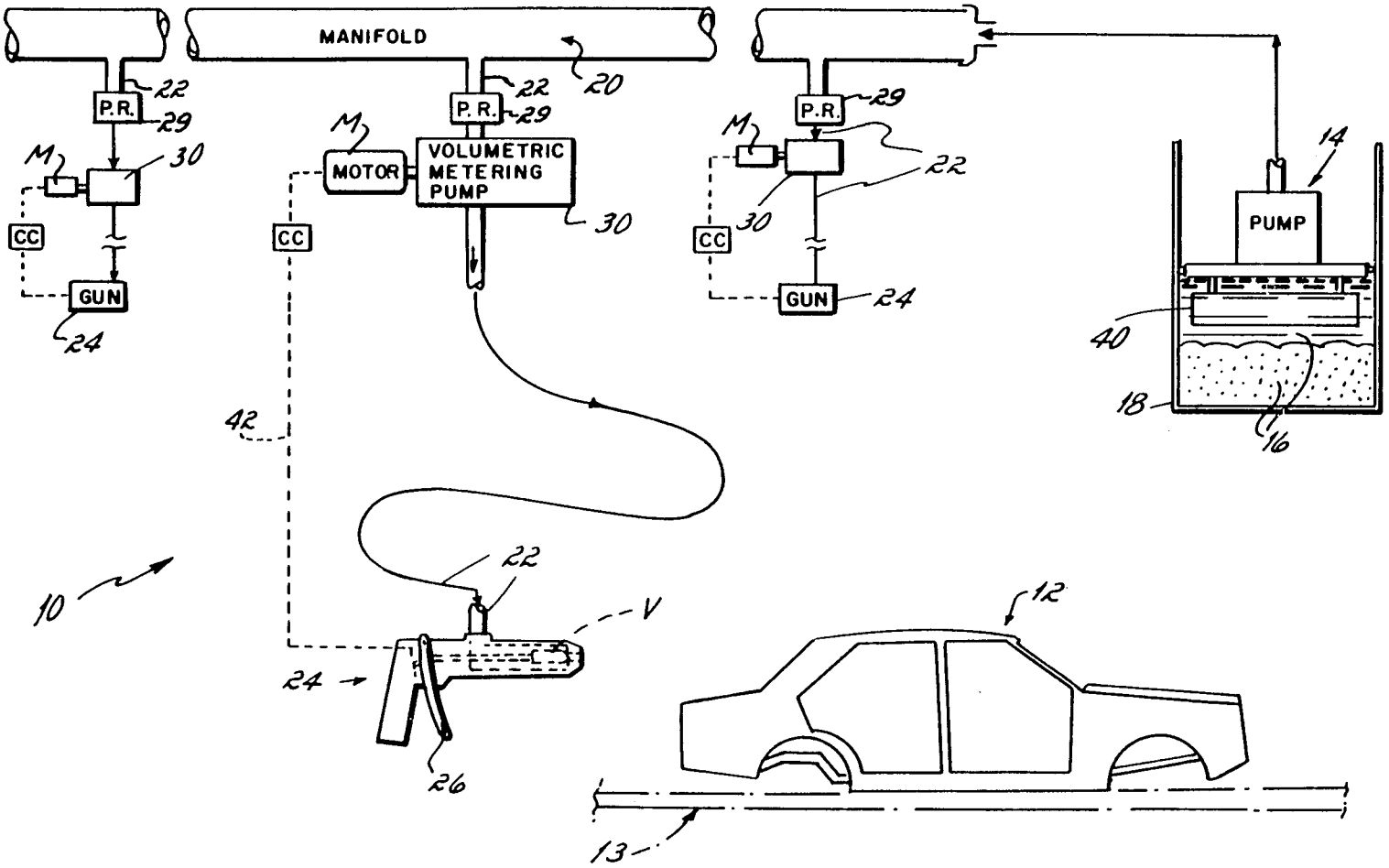
PUMP
14
16
18
40
12
13
22
29
P.R.
24
GUN
30
M
CC
20
MANIFOLD
VOLUMETRIC METERING PUMP
MOTOR
V
26
42
10

METHOD AND APPARATUS FOR SEALING WELDED SEAMS OF AUTOMOBILES

This invention relates to the sealing of welded seams of automobile bodies wherein finishing requirements dictate the welded seam be covered with a sealant either before or after the body is primed and painted. .

At the present time, some form of seam sealer is used to cover and protect very nearly every welded seam or joint of an automobile body. This seam sealer is applied for purposes of excluding water or air, preventing leaking, and combating corrosion. Presently, most commercial sealers comprise a vinyl plastisol or epoxy that is pumped via a reciprocating piston pump to a manually operated extrusion gun. Depending upon the volume of material consumed, the sealant is supplied either from a 55 gallon drum operable to feed a manifold system to which multiple guns are attached, or the sealant material is supplied from a five gallon can operable to supply only a single extrusion gun.

Prior art commercial seam sealant systems have generally been unsatisfactory because of large variations in the amount of deposit supplied to a seam. The problem is particularly acute at the beginning or end of each application when the flow control valves of the hand guns used for applying the sealant are opened or closed. Each opening and closing of the valves of the extrusion guns results in pump surges and pressure fluctuations which in turn cause wide flow variations of sealant pumped from the guns. Because of these wide flow variations, operators tend to apply excessive amounts of material in order to insure adequate coverage of all areas of the seams. This excessive application of material results in a messy or sloppy appearance which detracts from the quality and appearance of the resulting welded seams. In addition, the excess material commonly washes off the phosphate paint priming wash and becomes redeposited on exterior surfaces of the automobile thereby causing paint blemishes in the resulting product. In addition, the excess sealant material frequently contaminates the paint primer system.

For some time now automotive company engineers have been engaged in an extensive effort to find some means for providing a constant bead of sealant material with a predictable uniform size which would apply a complete covering of the welded seam without any excess of visible sealant material to mar the appearance of the finished product and contaminate subsequent finishing operations. To that end, those engineers have attempted in one instance to solve the problem by inserting fluid pressure regulators into each extrusion gun supply system immediately upstream of each of the extrusion guns. Those pressure regulators though did not solve this problem, primarily because the viscosity of the material was too great for regulators to operate effectively.

Still another attempt which has been made, but which has so far proven to be a failure, has been the use of a sealant tape cut to length and manually placed into the various welded seams. This tape sealant approach has proven to be too expensive to be practical because of the expensive form in which the sealant is delivered, i.e., the tape. Additionally, the tape requires significantly greater labor time to apply than is required to apply liquid through an extrusion gun.

It has therefore been one objective of this invention to provide an improved method and apparatus for applying sealant to a welded seam of an automobile so as to effectively cover that seam without the use of excessive sealant material.

Still another objective of this invention has been to provide an improved method and apparatus for applying sealant to a welded seam of an automobile in such a manner that sealer redeposition in the phosphate wash or in the primer paint system is avoided.

Still another objective of this invention has been to provide a very accurate method and apparatus for applying sealant to the welded seams of an automobile such that only so much sealant is applied as is required to cover the welded seam without the application of any excess material.

These objectives are accomplished and this invention is predicated upon the concept of utilizing a metering gear pump in the sealant supply system of each of the extrusion guns of an automobile welded seam sealant applicator system so as to accurately meter and control the volumetric deposition of sealant material from the gun. The sealant material may be either a holt melt sealant which is solid at room temperature and applied in a molten state or a cold unheated sealant. In either event, the metering gear pump downstream from a pressure regulator in the supply system to each of the extrusion guns eliminates pressure surges and uneven flow variations from the bead of material applied by the extrusion guns. Thereby, only so much sealant is applied to a welded seam as is required to adequately cover that seam without the application of excess material.

In one preferred embodiment, the system for applying the sealant to the welded seam of an automobile comprises a 55 gallon drum from which sealant material is pumped by a conventional reciprocating piston pump. This reciprocating piston pump supplies the sealant material to an overhead manifold line from which there extends a plurality of drop lines. Each drop line terminates in a manually or a robotic operated extrusion gun. According to the practice of this invention, an electric motor driven metering gear pump is connected to each of the drop lines downstream from a pressure regulator so that sealant is supplied to each of the exrusion guns through a metering pump at a fixed and constant pressure without any pump surges or pressure fluctuations. Thereby, an even and precise amount of sealant is extruded from each gun at a predetermined and accurately controlled rate.

These and other objects and advantages of this invention will be more readily apparent from the following description of the drawings in which:

The FIGURE is a partially diagrammatic illustration of a sealant application system for applying sealant to welded seams of an automobile incorporating the invention of this application.

With reference to the drawing, there is diagrammatically illustrated a system 10 for applying sealant to the welded seams of an automobile body and chassis 12. In general, all of the welded seams of an automobile body must be covered with a sealant material to exclude water or air and to combat corrosion. This sealant is either applied before or after the welding of the seams and either before or after any primer paint or any preparatory coating treatment of the body.

The system 10 comprises a reciprocating piston pump 14 for pumping sealant material 16 from a drum or container 18 to a distribution manifold 20. Because of the high viscosity of the sealant material, the pump 14 commonly supplies the material to the distribution manifold at a pressure on the order of 3,000 to 5,000 p.s.i.g. This manifold generally extends parallel to an automobile production line 13 and is operative to supply pressurized sealant from the pump 14 to a plurality of drop lines 22 through which the sealant is distributed to multiple extrusion guns 24 located along the production line. The guns 24 are illustrated herein as being of the manual type controlled from a manually operated trigger 26. One suitable gun is disclosed in U.S. Pat. No. 4,245,759. The guns could as well though be automatically operable guns controlled and moved relative to the body by robots.

There is associated with each drop line 22 a pressure regulator 29 and a volumetric metering pump 30. Each pump 30 comprises a two-speed DC motor driven gear pump. Since the gear pumps 30, and the motor M for driving the gear pumps, as well as the pressure regulators 29, are conventional commercially available items, they have not been illustrated or disclosed in detail herein.

The reciprocating piston pump 14 is a conventional pneumatic motor driven reciprocating piston pump. It may be either a single acting or a double acting pump, i.e., a pump which pumps on one of two strokes or pumps on both strokes. If the sealant material 16 is a hot melt material, then a heated platen 40 will be suspended beneath the pump to heat and melt the hot melt sealant material which is solid at room temperature. One appropriate heated platen is disclosed in U.S. Pat. No. 4,227,069. Alternatively, if the sealant is a cold sealant, i.e., liquid at room temperature, then the heated platen will be omitted and the pump 14 inlet simply inserted into the cold sealant 16 contained in the drum.

Irrespective of whether the pump 14 is single acting or double acting, there are pressure surges or variances associated with the reciprocation of the piston of the pump. At the end of each cycle of the piston there are conventional pressure drops. Heretofore, it has been the practice to supply the sealant material directly from the pump 14 to the extrusion gun 24 through a pressure regulator but without the presence of any volumetric metering pumps 30. As a result, pressure changes effected by reciprocation of the piston of the pump were reduced by the pressure regulator but were still transmitted through the distribution manifold to the gun. Those pressure changes resulted in varying flows of material from the gun. Additionally, pressure changes occurred whenever one gun of a plurality of guns operated from a common distribution manifold was opened or closed to initiate or terminate dispensing of adhesive material from that gun. These pressure changes, irrespective of their source, resulted in varying flow rates from the guns. The use of volumetric metering pumps upstream of the gun but downstream from the pressure regulators in each drop line 22 has been found to eliminate the pressure and flow variance which have heretofore been characteristic of automobile welded joint sealer systems.

As mentioned hereinabove, the pressure regulators 29 are commercially available items which, because of their commercial availability, have not been illustrated or described herein. The presence of these pressure regulators upstream of the metering pumps 30, but downstream from the manifold 20, has been found to generally be required to prevent over-speeding of the volumetric metering pumps 30. The necessity for these pressure regulators 29 derives from the very viscous nature of the sealant material 16. In general, the pump 14 is required to develop very high pressures, often on the order of 3,000 to 5,000 p.s.i.g. in order to supply the sealant material to the manifold 20. That pressure must be reduced to something on the order of 40 to 200 p.s.i.g. if over-speeding of the gear pumps 30 is to be avoided. In other words, in the absence of the pressure regulators 29, the very high pressure of the material 16 supplied from the pump 14 to the manifold would overcome and over-speed the gear pumps 30. The presence of the pressure regulators 29 prevent this overrunning or over-speeding of the pumps 30.

The metering pumps 30 are conventional motor driven gear pumps such as the gear pump disclosed in U.S. Pat. No. 4,009,974. In one preferred embodiment, this pump is motor driven by a two speed DC electric motor M. The use of a two speed motor has been found to be desirable if that motor is controlled from the trigger 26 of a manually operated gun 24 because it enables the operator of the gun to increase or decrease the rate at which material is dispensed from the gun in accordance with the needs or requirements of the application. Specifically, it has been found that when applying sealant with a manual gun to a straight welded seam, high speed application may be employed, but when applying the sealant to a rounded corner, a slower speed is required in order to effect complete coverage of the seam without application of excessive sealant material. Robot controlled guns may use an even greater number of motor speeds to drive the metering pump 30.

In use, the reciprocating pump 14 is actuated when the system is turned on and before the valves of any of the extrusion guns are opened. This results in viscous sealant material being supplied at a very high pressure, generally on the order of 3,000 to 5,000 p.s.i.g. from the drum 18 into the distribtuion manifold 20. This sealant material is then supplied from the distribution manifold 20 through the pressure regulators 29 and the metering pumps 30 the the extrusion guns 24. When the trigger 26 of a gun 24 is actuated so as to open the valve V contained internally of the gun 24, the motor M for driving the gear pump 30 is actuated and sealant material is dispensed from the gun at a controlled volumetric rate for so long as the trigger remains open. That rate will remain constant irrespective of any pressure fluctuations which may occur in the distribution manifold 20 because of the presence of the motor driven gear pumps 30. If more sealant is required, as for example because the gun is being moved at a fast rate over a straight section of welded seam, greater quantities of sealant may be obtained by adjusting the trigger 26 of the guns 24 to secure high motor speed. This trigger is preferably connected via a conventional electric control circuit to the motor M of the gear pump 30 so that by controlling the trigger, the actuation and speed of the motor M is controlled. The control circuit which connects the trigger 26 of each of the guns 24 to the associated motor M of the metering pump 30 through which a sealant is supplied to the gun 24 is a conventional electrical control circuit which could readily be supplied by a person skilled in this art. Accordingly, it has only been diagrammatically illustrated and represented by the dashed line 42 and the box labeled CC.

In lieu of a manual gun 24, the sealant may be dispensed from a conventional robot controlled automatic gun. In that event, the control circuit CC would be a part of a programmed control for the automatic gun, the robot, and the motor M for driving the metering pump 30 or a clutch operable between the motor M and the metering pump 30 for controlling actuation of the metering pump 30.

While we have described only a single embodiment of our invention, persons skilled in the art to which our invention pertains will appreciate numerous modifications and changes which can be made without departing from the spirit of our invention. Therefore, We do not intend to be limited except by the scope of the following appended claims.

We claim:

1. A system for dispensing viscous sealant material onto a welded seam of an automobile, which system comprises a distribution manifold extending generally parallel to an automobile production line, a plurality of extrusion guns, a plurality of drop lines, each of said drop lines having upper ends connected to said distribution manifold and lower ends connected to one of said extrusion guns, a primary pump for supplying sealant to said distribution manifold, a plurality of volumetric metering pumps, one of said volumetric metering pumps being motor driven and operatively connected to each one of said drop lines so as to accurately control the rate of flow of sealant from said distribution manifold to one of said extrusion guns, and a plurality of pressure regulators, one of said pressure regulators being located in each of said drop lines between said distribution manifold and one of said volumetric metering pumps.

2. The system of claim 1 wherein said primary pump is a reciprocating piston pump.

3. The system of claim 1 wherein each of said volumetric metering pumps is a motor driven gear pump.

4. The system of claim 2 wherein each of said volumetric metering pumps is driven by a DC electric motor.

5. The system of claim 4 wherein each of said DC electric motors is a two speed electric motor.

6. The system of claim 3 wherein said extrusion gun is a manually operated gun having a valve contained therein, said valve being controlled by a trigger associated with said gun.

7. The system of claim 4 wherein each of said DC electric motors is a variable speed motor, and a trigger controlling the speed of said DC electric motor.

8. A method of applying viscous sealant material to a welded seam of an automobile, which method comprises, supplying sealant material from a bulk sealant reservoir to a distribution manifold at a pressure substantially greater than that of the atmosphere, supplying said sealant material from said distribution manifold to a plurality of sealant dispensing extrusion guns, each of said extrusion guns containing a flow control valve, passing said sealant material from said distribution manifold to each of said extrusion guns through a pressure regulator to substantially reduce the pressure of said sealant material, and metering the flow of sealant material from a pressure regulator to each of said extrusion guns by means of a motor driven metering pump so as to maintain an even flow of sealant material from said extrusion guns upon actuation of said flow control valves irrespective of pressure changes which may occur in said sealant material contained in said distribution manifold.

* * * * *

UNITED STATES PATENT AND TRADEMARK OFFICE

CERTIFICATE OF CORRECTION

PATENT NO. : 4,682,711

DATED : July 28, 1987

INVENTOR(S) : Alan B. Reighard, et al.

It is certified that error appears in the above-identified patent and that said Letters Patent is hereby corrected as shown below:

Column 2, line 17, change "of each" to --to each--.

Column 2, line 21, change "holt" to --hot--.

Column 4, line 39, change "pumps 30 the the" to --pumps 30 to the--.

Signed and Sealed this

Sixth Day of December, 1988

*Attest:*

*Attesting Officer*

DONALD J. QUIGG

*Commissioner of Patents and Trademarks*